US005361544A

United States Patent [19]

Yang

[11] Patent Number: 5,361,544

[45] Date of Patent: Nov. 8, 1994

[54] APPARATUS AND METHOD FOR GRINDING, POLISHING AND BURNISHING OPERATIONS ON A STATIONARY WORKPIECE TO RELIEVE INTERNAL STRESSES OR PRECLUDE MATERIAL FLOW IN THE WORKPIECE DURING OPERATIONS THEREON

[76] Inventor: Tai-Her Yang, 5-1 Taipin St., Si-Hu Town, Dzan-Hwa,

[21] Appl. No.: 58,562

[22] Filed: May 6, 1993

Related U.S. Application Data

[63] Continuation-in-part of Ser. No. 765,927, Sep. 24, 1991, abandoned.

[51] Int. Cl.[5] ..... B24B 7/00

[52] U.S. Cl. ..... 451/231; 451/130; 451/182; 451/58; 451/57

[58] Field of Search ..... 51/98 R, 38, 39, 74 R, 51/98 SP, 165.77, 165.71, 165.8, 281 R, 326, 327

[56] References Cited

U.S. PATENT DOCUMENTS 4,984,394 1/1991 Suzuki ..... 51/165.71

FOREIGN PATENT DOCUMENTS 58-177261 10/1983 Japan ..... 51/39

*Primary Examiner*—Bruce M. Kisliuk
*Assistant Examiner*—Eileen Morgan
*Attorney, Agent, or Firm*—Leonard Bloom

[57] ABSTRACT

An apparatus and a method for performing working operations, such as grinding, polishing and burnishing, on a workpiece. A first and a second working tool are disposed for working movement in, respectively a first and second axis in a first plane and a second plane. The first and second working tools are operated at right angles to one another. The working tools perform work on the workpiece sequentially such that only one of the working tools is in contact with the workpiece at a given time. In this manner, any residual stresses in the workpiece generated by either one of the working tools will be cancelled out by the other one of the working tools. In this fashion, internal stresses in the workpiece are relieved for preventing any flow or deformation of the material in the workpiece during operations thereon.

2 Claims, 14 Drawing Sheets

APPARATUS AND METHOD FOR GRINDING, POLISHING AND BURNISHING OPERATIONS ON A STATIONARY WORKPIECE TO RELIEVE INTERNAL STRESSES OR PRECLUDE MATERIAL FLOW IN THE WORKPIECE DURING OPERATIONS THEREON

CROSS REFERENCE TO RELATED APPLICATION

This application is a continuation-in-part of copending application Ser. No. 765,927, filed on Sep. 24, 1991 now abandoned, the disclosure of which is incorporated by reference herein in its entirety.

FIELD OF THE INVENTION

The present invention relates to apparatuses and methods for performing working operations on a workpiece and, in particular, to such apparatuses and methods for grinding, polishing and burnishing stationary workpieces in which residual stresses in the workpiece that are generated are relieved for preventing any flow or deformation of the material in the workpiece during the operations thereon.

BACKGROUND OF THE INVENTION

There are numerous apparatuses and methods which have been disclosed that provide for the grinding, polishing and burnishing of workpieces. These apparatuses and methods permit such work to be performed on workpieces which are both stationary and moving. Examples of such apparatuses and methods are grinding centers, as well as the more conventional grinding machines, and the methods in which they are used.

While useful for their purposes, the use of such apparatuses and methods for working on stationary workpieces presents particular problems. Specifically, where stationary workpieces are involved, internal residual stresses can build-up in the workpieces that are generated by the working tool (i.e., a grinding wheel). These internal residual stresses can, in turn, result in a flow, or other deformation, of the material in the workpiece. Such deformed workpieces are useless, resulting in losses of time and material.

A method and apparatus for grinding straight edge cutting tools is disclosed in U.S. Pat. No. 4,984,394 issued to Suzuki et al. The grinder units concurrently grind opposite sides of the workpiece providing the opportunity to introduce internal stresses. Japanese Patent No. 58-177261 issued to Yonezawa discloses multiple wire brushes simultaneously contacting the surface of tubing. Italian Patent No. 511722 discloses working tools movable along parallel axes which do not intersect perpendicularly.

Accordingly, it can be seen that there remains a need for apparatuses and methods for grinding, polishing or burnishing a stationary workpiece which relieve the internal residual stresses in the workpiece which can result in flow or deformation of the material therein during operations thereon.

SUMMARY OF THE INVENTION

It is a primary object of the present invention to provide an apparatus for grinding, polishing and burnishing a stationary workpiece while reducing or substantially eliminating the flow or deformation of the material therein.

It is a further primary object of the present invention to provide an apparatus in which the internal residual stresses that build-up in a stationary workpiece during the operations thereon are relieved.

It is another object of the present invention to provide an apparatus that permits sequential work on the stationary workpiece in both a horizontal and a vertical plane.

Yet another object of the present invention is to provide such an apparatus that is simple in construction and operation.

In another aspect of the present invention, a primary object of the present invention is to provide a method for the grinding, polishing and burnishing of a stationary workpiece without the flow or deformation of the material in the workpiece.

A further primary object of the present invention is to provide a method in which the internal residual stresses that build-up in a stationary workpiece during the operations thereon are relieved.

Still another object of the present invention is to provide such a method in which work is sequentially performed on a stationary workpiece in both a horizontal and a vertical plane. Yet another object of the present invention is to provide such a method that is simple, efficient and easy to perform.

In accordance with the teachings of the present invention, there is disclosed an apparatus for performing working operations on a workpiece. This apparatus includes a frame. The frame includes a support portion for supporting a workpiece thereon. A first working tool is supported by the frame. The first working tool is disposed for movement of the first tool along a first axis in a first plane. In this manner, work is performed on the workpiece along the first axis. A second working tool is supported by the frame. The second tool is disposed for movement of the second tool along a second axis in a second plane. In this manner, work is performed on the workpiece along the second axis. The first axis and the second axis are substantially perpendicular to one another, such that a substantially 90° angle is formed therebetween. In the above fashion, the first and second working tools may be operated at right angles to one another. The working tools perform work on the workpiece sequentially such that only one of the working tools is in contact with the workpiece at a given time. This permits any residual stresses in the workpiece that are generated by either one of the working tools to be cancelled out by the other one of the working tools. In this manner, internal stresses in the workpiece are relieved for preventing any flow or deformation of the material in the workpiece.

Preferably, the apparatus further includes a means for maintaining the workpiece in a selected position. In this fashion, the workpiece is maintained in the selected position so as to be stationary while work is performed on the workpiece.

It is further preferred that the first working tool and the second working tool are disposed on respective axes, the respective axes are perpendicular to the respective first axis and the second axis along which the working tools are moved. The respective axes on which the working tools are disposed are substantially perpendicular to one another, such that a substantially 90° angle is defined therebetween.

The working tools of the apparatus of the present invention may be either grinding, polishing or burnishing tools for performing grinding, polishing or burnishing operations on the workpiece.

In further accordance with the teachings of the present invention a method is disclosed for performing working operations on a workpiece. The method includes maintaining a workpiece in a stationary position and sequentially operating a pair of working tools at right angles to one another such that only one of the working tools is in contact with the workpiece at a given time. In this fashion, any residual stresses in the workpiece generated by either one of the working tools will be cancelled out by the other one of the working tools. In this manner, internal stresses in the workpiece are relieved for preventing any flow or deformation of the material in the workpiece.

The operations that may be carried in the method of the present invention includes grinding, polishing and burnishing operations.

These and other objects of the present invention will become readily apparent from a reading of the following description, taken in conjunction with the drawings appended hereto.

DESCRIPTION OF THE PREFERRED EMBODIMENTS

Figure 1:
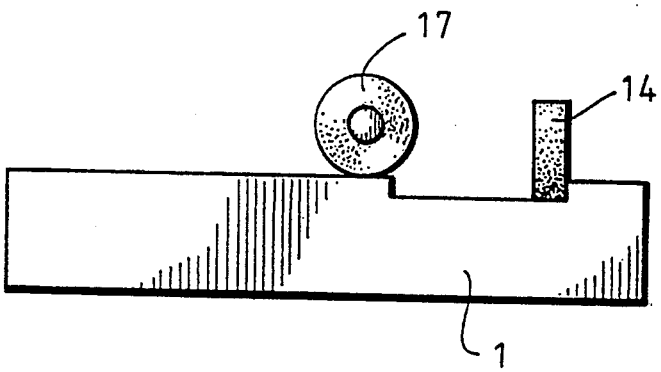
FIG. 1 is a side view illustrating the positioning and movement of the working tools of the apparatus and method of the present invention.

Referring now to the drawings, and in particular to FIGS. 1–7, the apparatus 10 of the present invention is now discussed.

The apparatus of the present invention includes a support frame 11 which supports the workpiece 1 thereon, as well as the other various elements of the apparatus of the present invention.

Carried by the frame 11 is a first (horizontal) working tool guide 12. Preferably, guide 12 may be a guide rail or any other structure well known to those skilled in the art. A first (horizontal) working tool guide carriage or seat 13 is horizontally slidingly carried by the guide 12 for movement of the first working tool guide carriage 13 along a first axis in a first plane.

Sliding mediums, such as ball bearings, pneumatic membranes or other mediums well known to those skilled in the art may also be provided to facilitate the sliding movement of the guide carriage 13 on the tool guide 12.

Carried in this manner, the tool guide 12 may be moved linearly during working operations in a reciprocating fashion. The carriage 13, in turn, includes therein or carries a first (horizontal) working tool 14. This first working tool 14 may be a grinding tool, such as a grinding wheel, or any other conventional or unconventional tool, such as a polishing wheel, a burnishing wheel or a cutting tool which are well-known to those skilled in the art.

The first working (horizontal) tool 14 is disposed and oriented on a first (horizontal) axis for reciprocal sliding movement along the first (horizontal) plane. In this fashion, the first working (horizontal) tool 14 may contact the top of the workpiece 1 for performing work operations on the workpiece 1 in the first plane, such as the facing off, grinding, polishing or burnishing of the top of the workpiece 1.

Also carried by the frame 11 is a second (vertical) working tool guide 15. Preferably, guide 15 may be a guide rail or any other structure well known to those skilled in the art. A second (vertical) working tool guide carriage or seat 16 is vertically slidingly carried by the guide 15 for movement of the second working tool guide carriage 16 along a second axis in a second plane.

Sliding mediums, such as ball bearings, pneumatic membranes or other mediums well known to those skilled in the art may also be provided to facilitate the sliding movement of the guide carriage 16 on the tool guide 15.

Carried in this manner, the tool guide 15 may be moved linearly along a second axis during working operations in a reciprocating fashion. The carriage 16, in turn, includes therein or carries a second (vertical) working tool 17. This second working tool 17 may be a grinding tool, such as a grinding wheel, or any other conventional or unconventional tool, such as a polishing wheel, a burnishing wheel or cutting tool which are well-known to those skilled in the art.

The second working (vertical) tool 17 is disposed and oriented on a second (vertical) axis for reciprocal sliding movement along the second (vertical) plane. In this fashion, the second working (vertical) tool 17 may contact the workpiece 1 for performing work operations on the workpiece 1 in the second plane, such as for cutting transverse slots or steps in the workpiece 1.

Figure 2:
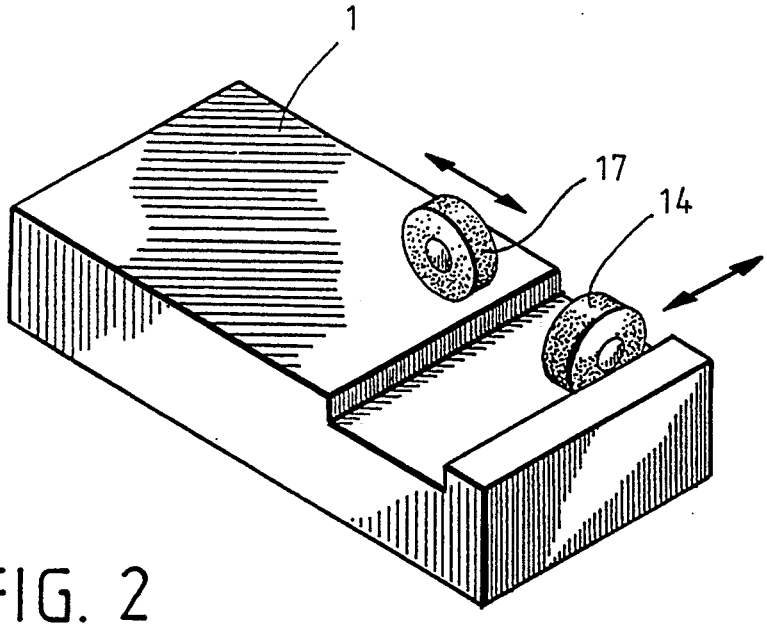
FIG. 2 is a perspective view corresponding to FIG. 1.

In the context of the present invention, the horizontal plane is to be substantially perpendicular to the vertical plane, so that a substantially 90° angle is defined therebetween. Similarly, the first and second axes are substantially perpendicular to one another, so that a substantially 90° angle is defined therebetween. Additionally, the first axis and second axis along which the tool is moved are substantially perpendicular to one another as seen in FIG. 2.

Figure 3:
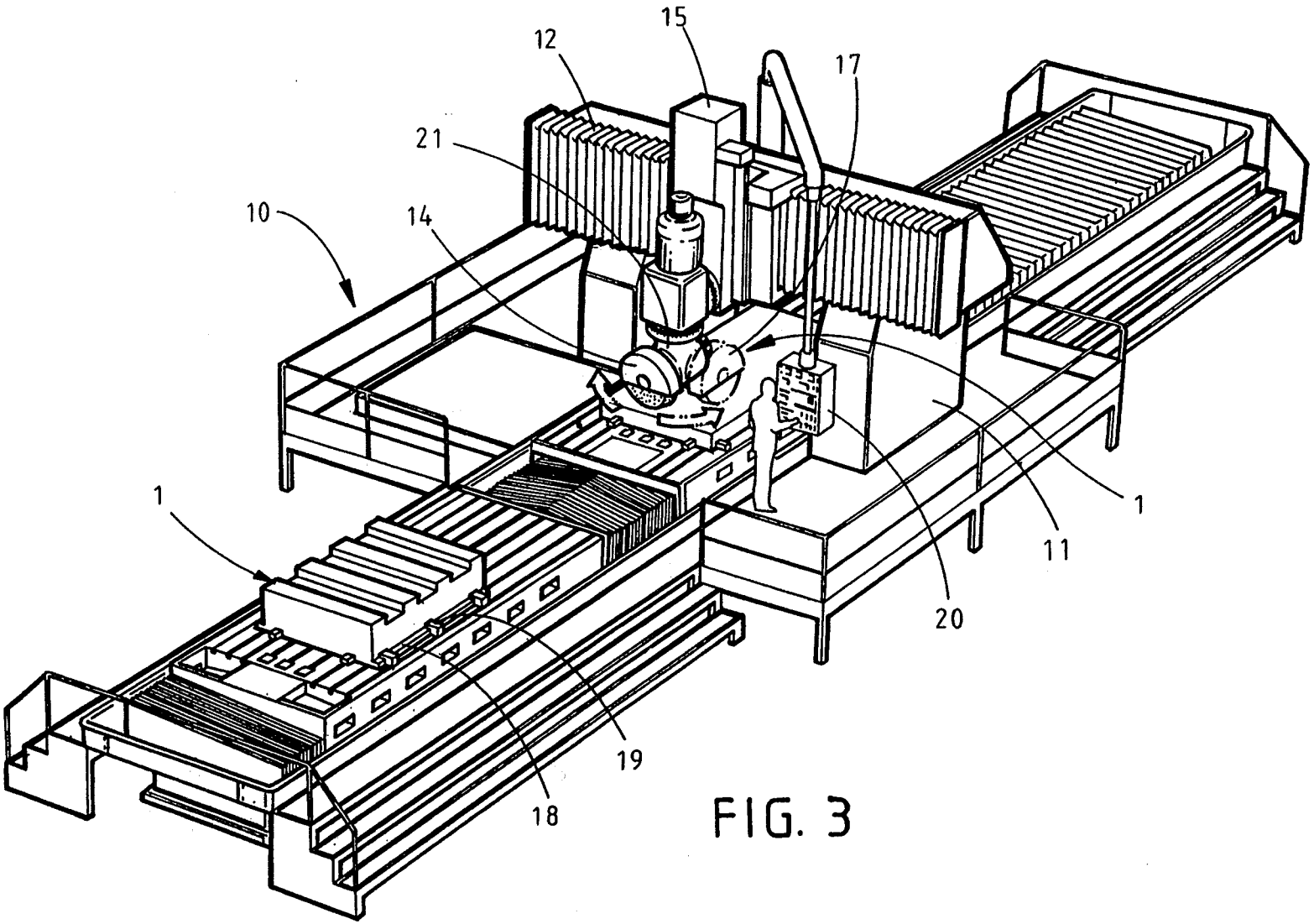
FIG. 3 is a perspective view of a first embodiment of the apparatus of the present invention, wherein the apparatus is incorporated into a grinding, polishing or burnishing center.
Figure 4:
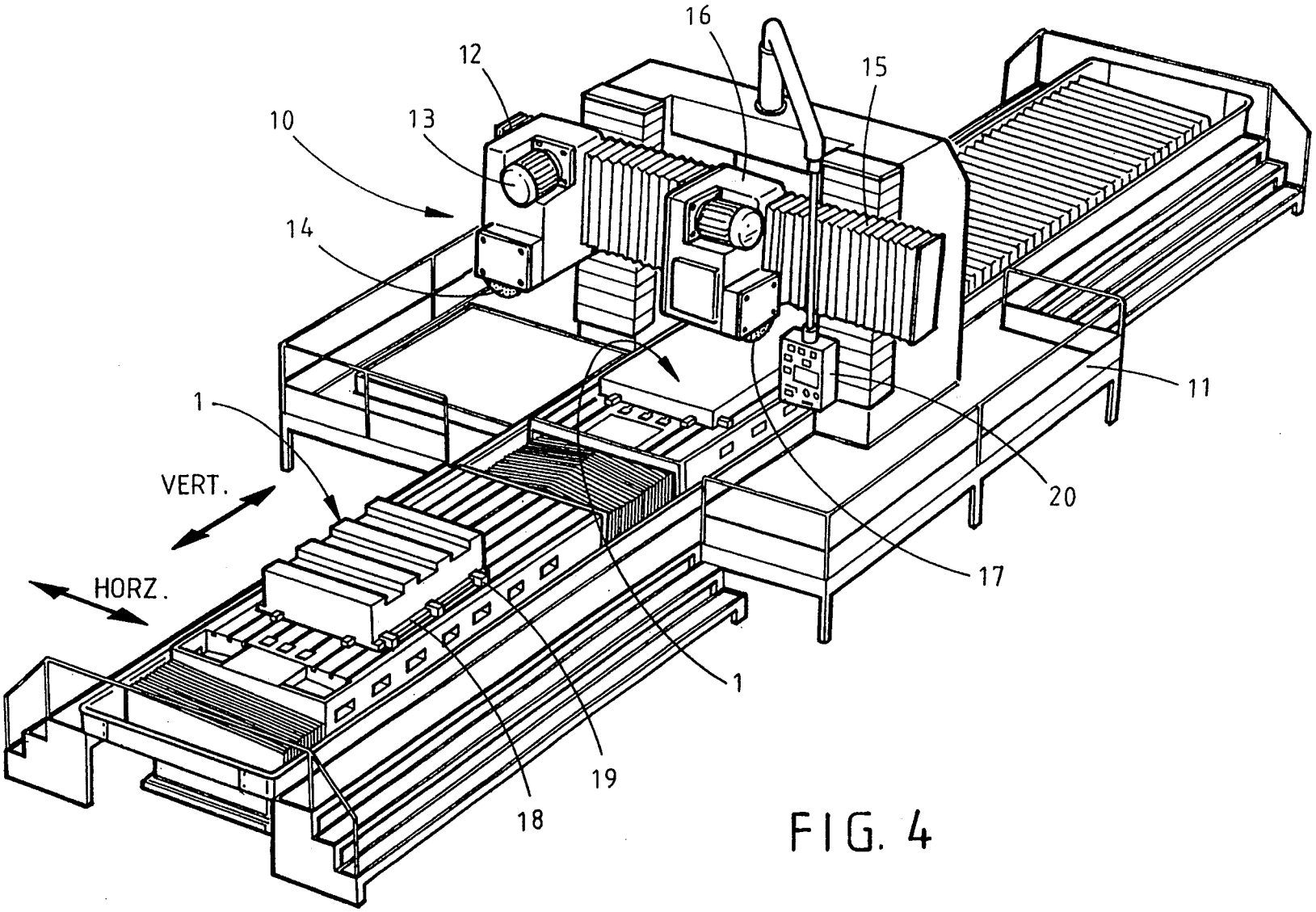
FIG. 4 is a perspective view of a second embodiment of the apparatus of the present invention, wherein the apparatus is incorporated into a grinding, polishing or burnishing center.
Figure 5:
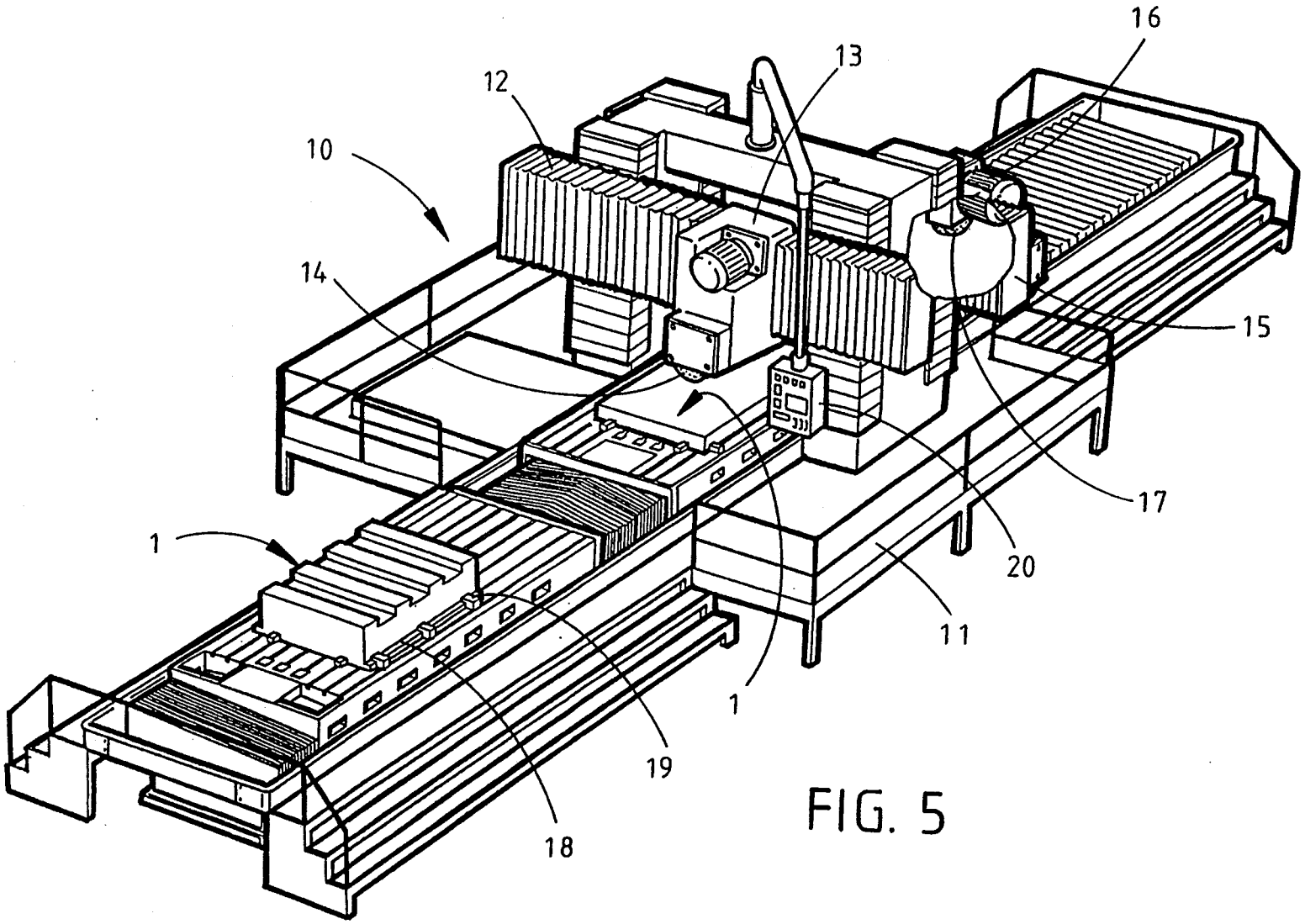
FIG. 5 is a perspective view of a third embodiment of the apparatus of the present invention, wherein the apparatus is incorporated into a grinding, polishing or burnishing center.

It is noted that the guides 12 and 15 may be incorporated into a carrousel 21 which is supported by the frame 11 on an axis substantially perpendicular to the workpiece 1. In this manner, the carrousel may be rotated to sequentially direct the selected working tool 14, 17 to the workpiece 1 (FIG. 3). Alternatively, the guides 12 and 15 may be incorporated into a single beam structure (FIG. 4). Finally, the guides 12 and 15 may be incorporated into a structure having two separate beams (FIG. 5).

The frame 11 also includes a support portion or bench 18 on which the workpiece 1 is positioned and supported while work is performed thereon. This support portion 18 has means which are provided for securing and maintaining the workpiece 1 in a selected position. Such means includes clamps 19, or any other such conventional means which are well known to those skilled in the art, that are carried by the frame 11. In this fashion, the workpiece 1 is maintained in the selected position, so as to be stationary while work is performed thereon.

The support portion or bench 18 is slidingly carried by the frame 10 by any suitable means, such as guide rails, well known to those skilled in the art. In this manner, the workpiece 1 that is secured to and carried thereon may be linearly moved. In particular, such a feature permits the workpiece 1 to be moved as desired to permit work to be progressively performed thereon.

Movement of the working tool guide carriages 13 and 16 can be performed by the use of a drive motor, gear rack, pneumatic or hydraulic pump, connecting rod, guide screw or any other means well-known to those skilled in the art.

Finally, movement of the tool guide carriages 13 and 16, as well as the operation and movement of the tools 14 and 17 can further be controlled by a control panel 20, which panel 20 may receive manual input from the operator of the apparatus 10. If desired, the operation of the device 10 may be preprogrammable, so as to be fully automatic. In this respect, the operation of the apparatus 10 and its various parts may be programmed and controlled by use of the control panel 20 that is provided for this purpose and which is integrated with various structures of the apparatus in a manner which is well known to be skilled in the art.

Figure 7:
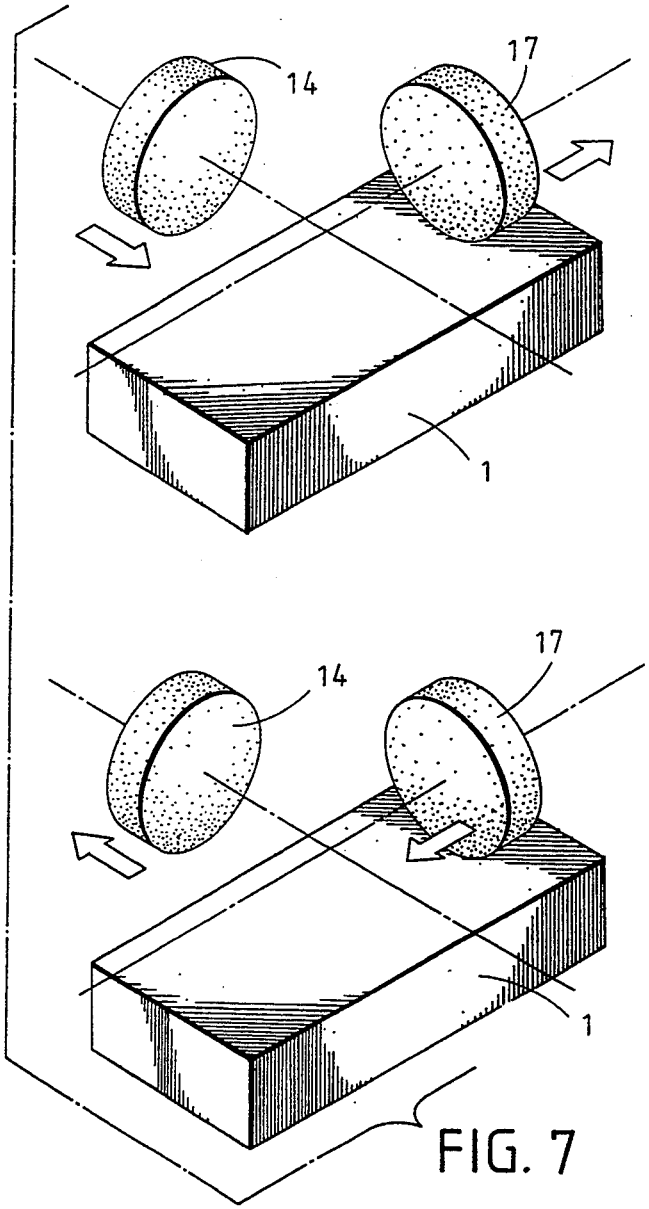
FIG. 7 is a schematic diagram showing sequential work on the workpiece by the working tools.

The apparatus of the present invention permits the first and second working tools 14 and 17 to be operated both independently of one another and also simultaneously at right angles to one another. In this regard, it is noted that the tools 14 and 17 may be driven at either constant speeds or at variable speeds. They may also be driven unidirectionally or bidirectionally. It is preferred that the working tools 14, 17 perform work on the workpiece 1 in a sequential manner such that only one of the working tools 14, 17 are in contact with the workpiece 1 at any given time. Thus, working tool 14 works on the workpiece and is moved away from the workpiece 1 before working tool 17 initiates work on the workpiece 1. If desired, working tool 17 may be removed from the workpiece 1 and working tool 14 again moved to work on the workpiece 1. The sequential work by the respective working tools 14, 17 is conducted until the desired work on the workpiece 1 is completed (FIG. 7).

With such operation, any internal residual stresses in the workpiece that are generated by either one of the tools 14 or 17 will be relieved by being cancelled out by the other one of the tools 14 or 17. In this fashion, any flow or deformation of the material in the workpiece is prevented.

Figure 6:
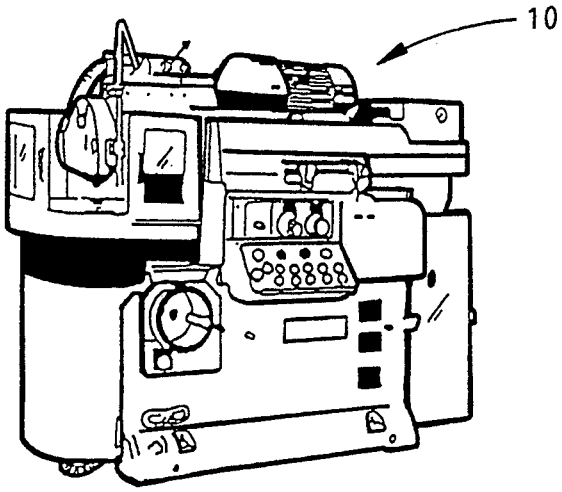
FIG. 6 is a perspective view of the apparatus of the present invention incorporated into a grinding, polishing or burnishing machine.

As can be readily seen, the apparatus of the present invention may be formed so as to be incorporated into either a large device, such as a grinding center (FIGS. 3–5) or into the more conventional modestly sized machines (FIG. 6).

It is also noted that, if desired, the working tool guides 13 and 16, and the working tools 14 and 17, respectively, that are carried thereby, may also be moved upwardly and downwardly. In this fashion, the height of the working tool guides 13 and 16, as well as the working tools 14 and 17, respectively, that are carried thereby may be adjusted, as desired.

Figure 8:
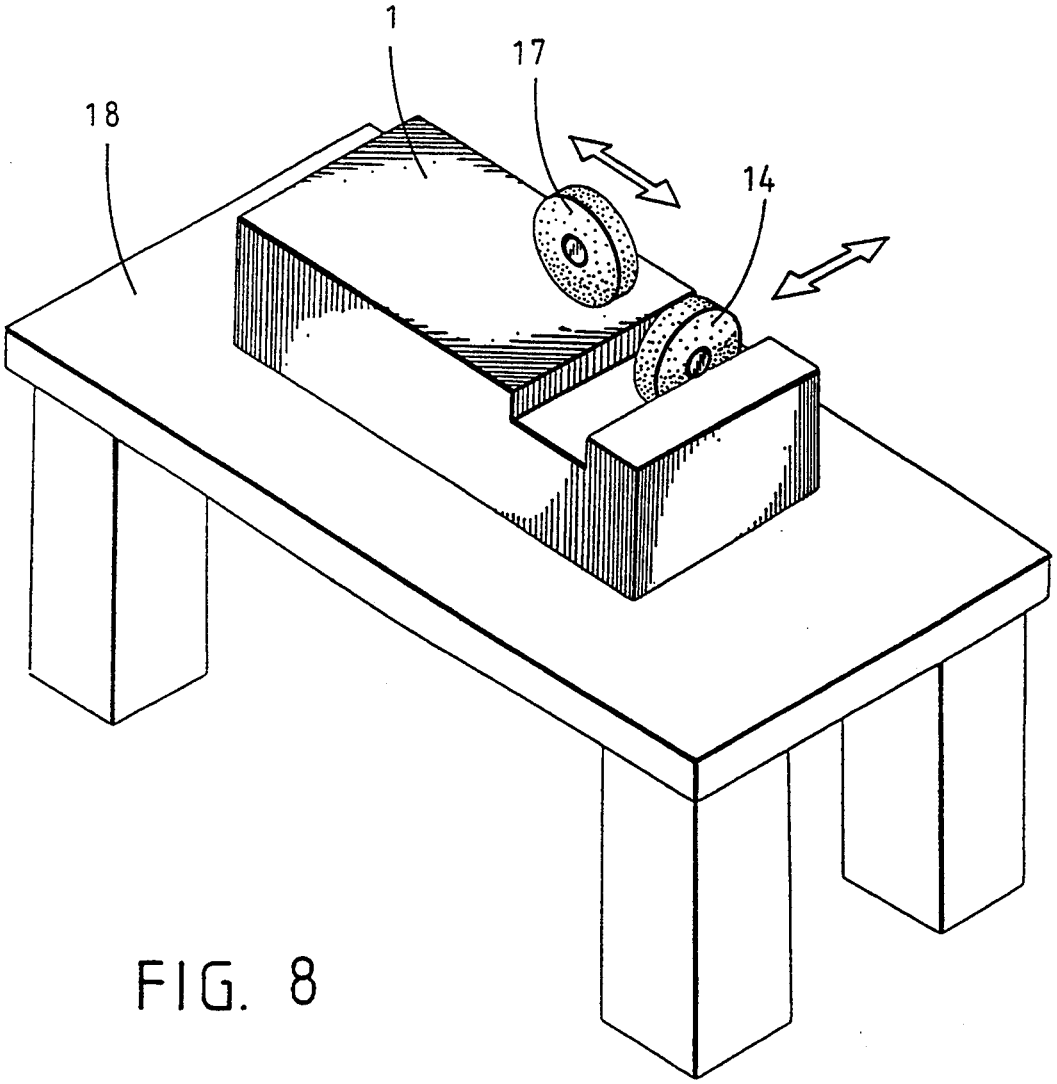
FIG. 8 schematically illustrates the method of the present invention.

Having thus discussed the apparatus 10 of the present invention, with further particular reference now to FIG. 8, the method of the present invention for performing working operations on a workpiece is now discussed.

First, the workpiece is positioned on the support bench 18, so as to be supported thereby. Then the workpiece 1 is secured to the support bench 18 by the use of securing clamps or any other suitable means.

Next, the working tools 14 and 17 are operated, so as to be moved along the first and second axes at right angles to one another. Preferably, such operation occurs sequentially. In this fashion, interference is avoided and any residual stresses in the workpiece generated by either one of the working tools 14 or 17 will be cancelled out by the other one of the working tools 17 or 14. In this manner, internal stresses in the workpiece 1 is relieved for preventing any flow or deformation of the material in the workpiece 1 during operations thereon.

As was discussed above, the method of the present invention is useful for grinding, polishing and burnishing operations, as well as other operations, such as cutting operations that are obvious to those skilled in the art.

Figure 9:
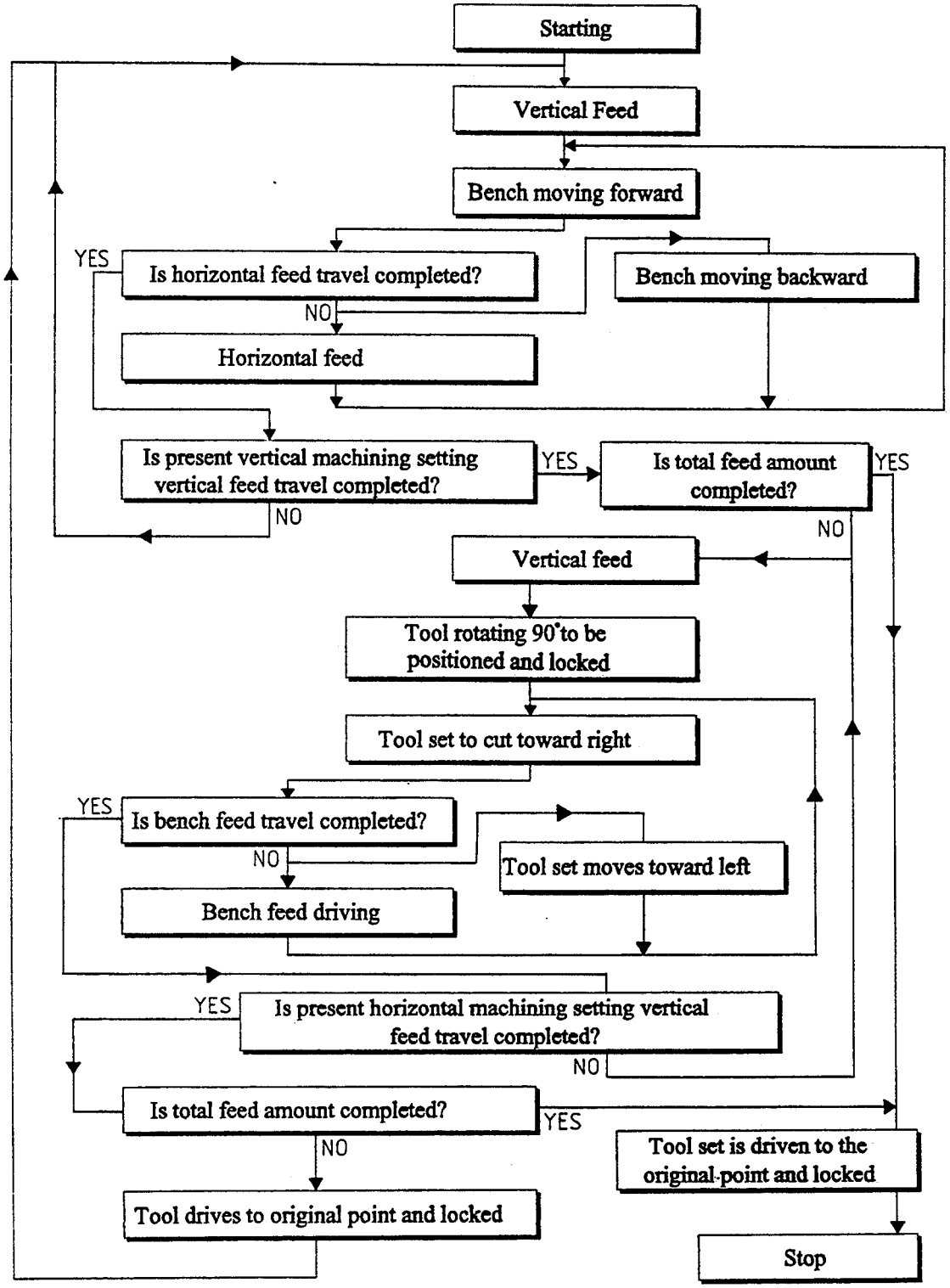
FIG. 9 is a diagram of a single tool cross operation method.
Figure 10:
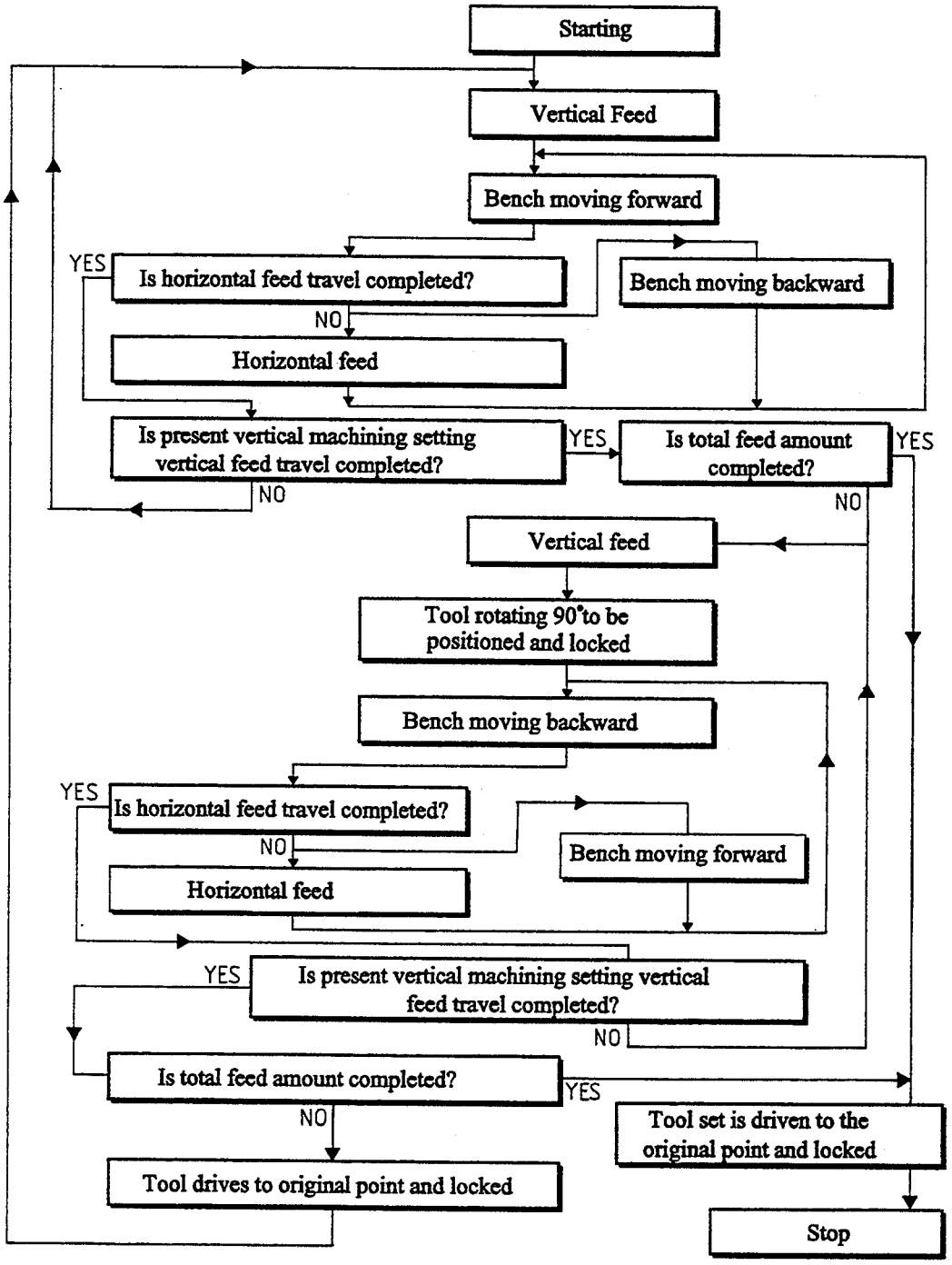
FIG. 10 is a diagram of a single tool vertical obverse and reverse operations method.
Figure 11:
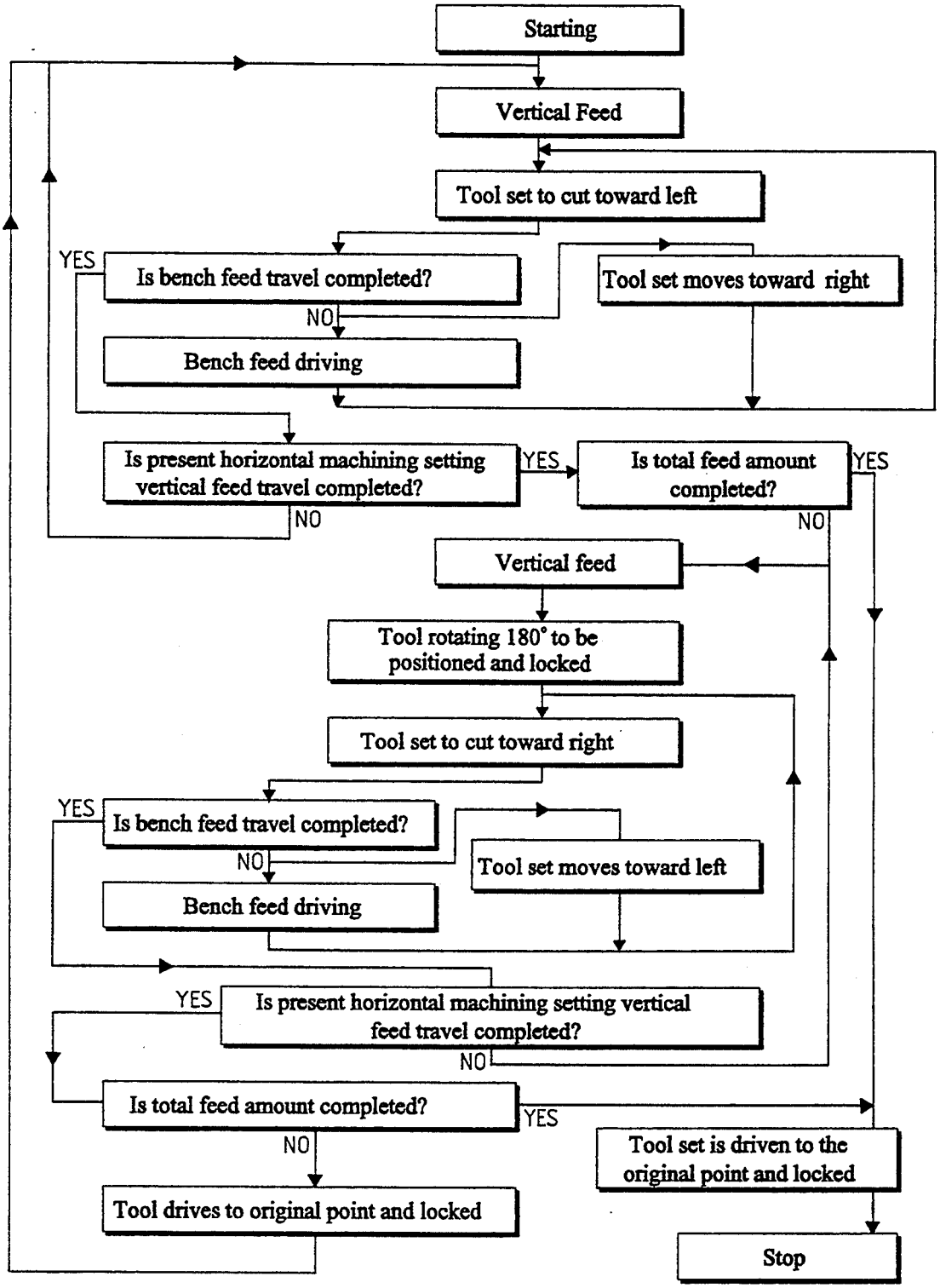
FIG. 11 is a diagram of a single tool horizontal obverse and reverse operation method.
Figure 12:
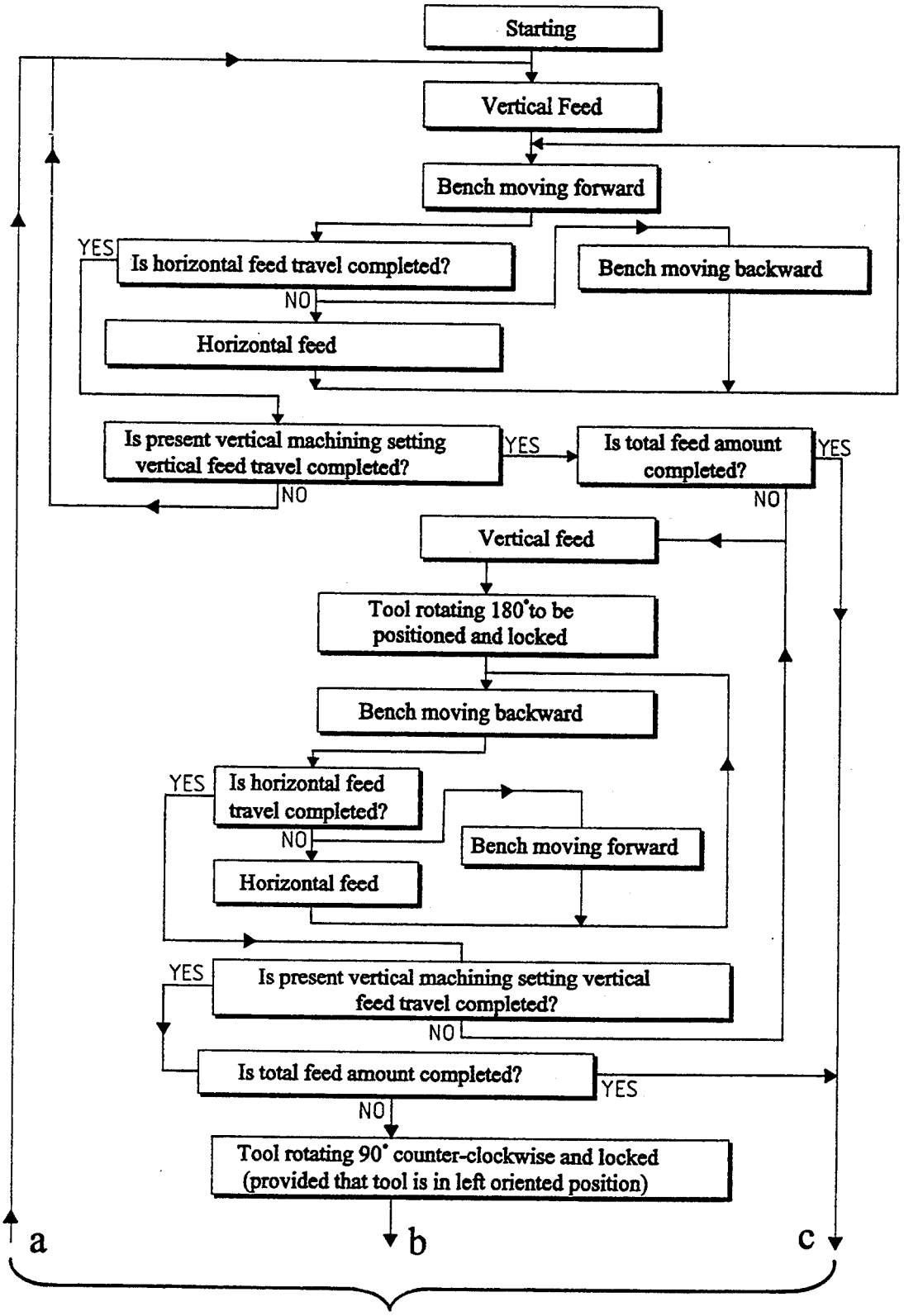
FIG. 12 is a partial diagram of a single tool cross obverse and reverse operation method.
Figure 13:
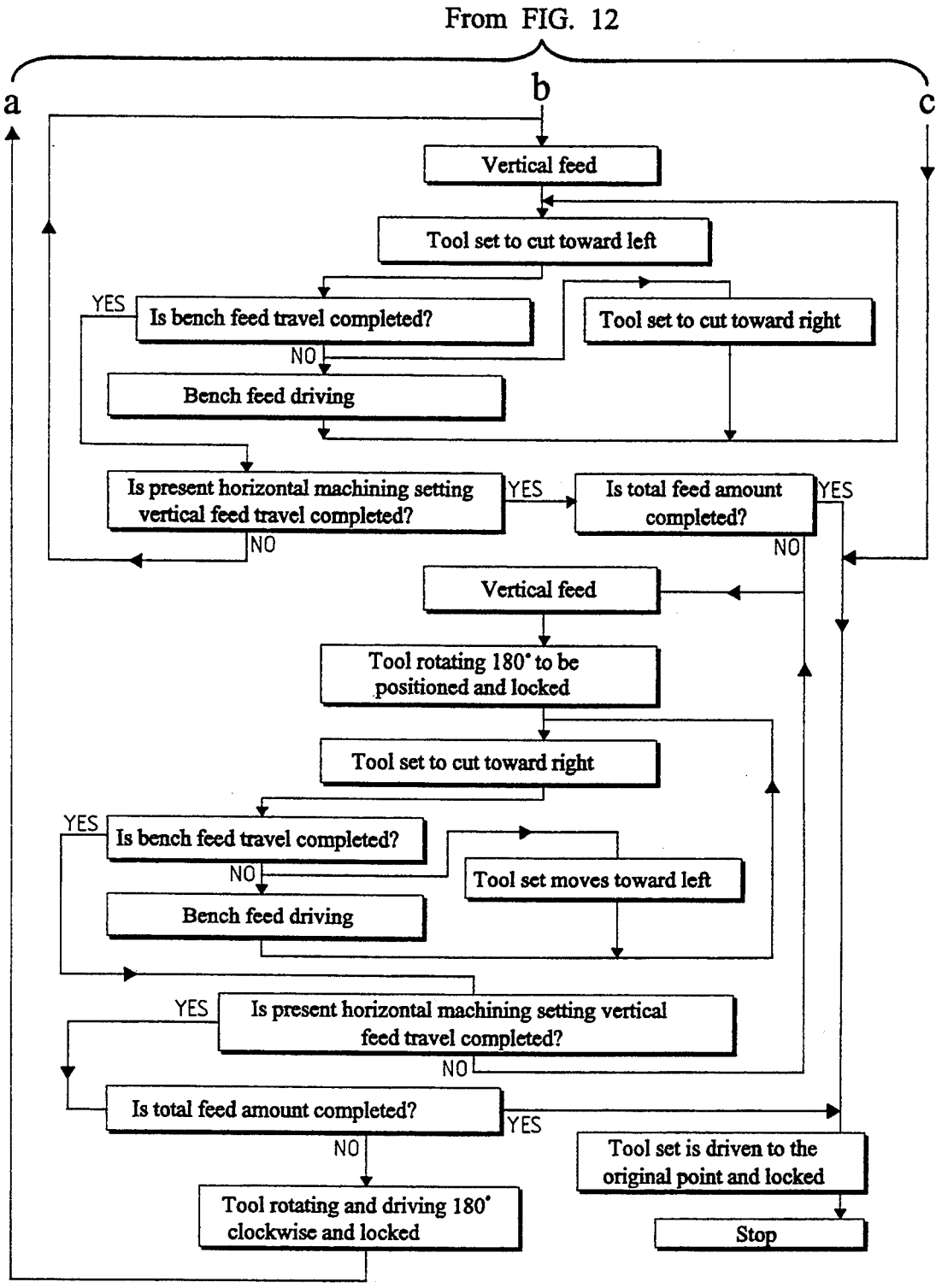
FIG. 13 is a continuation of the diagram of FIG. 12.
Figure 14:
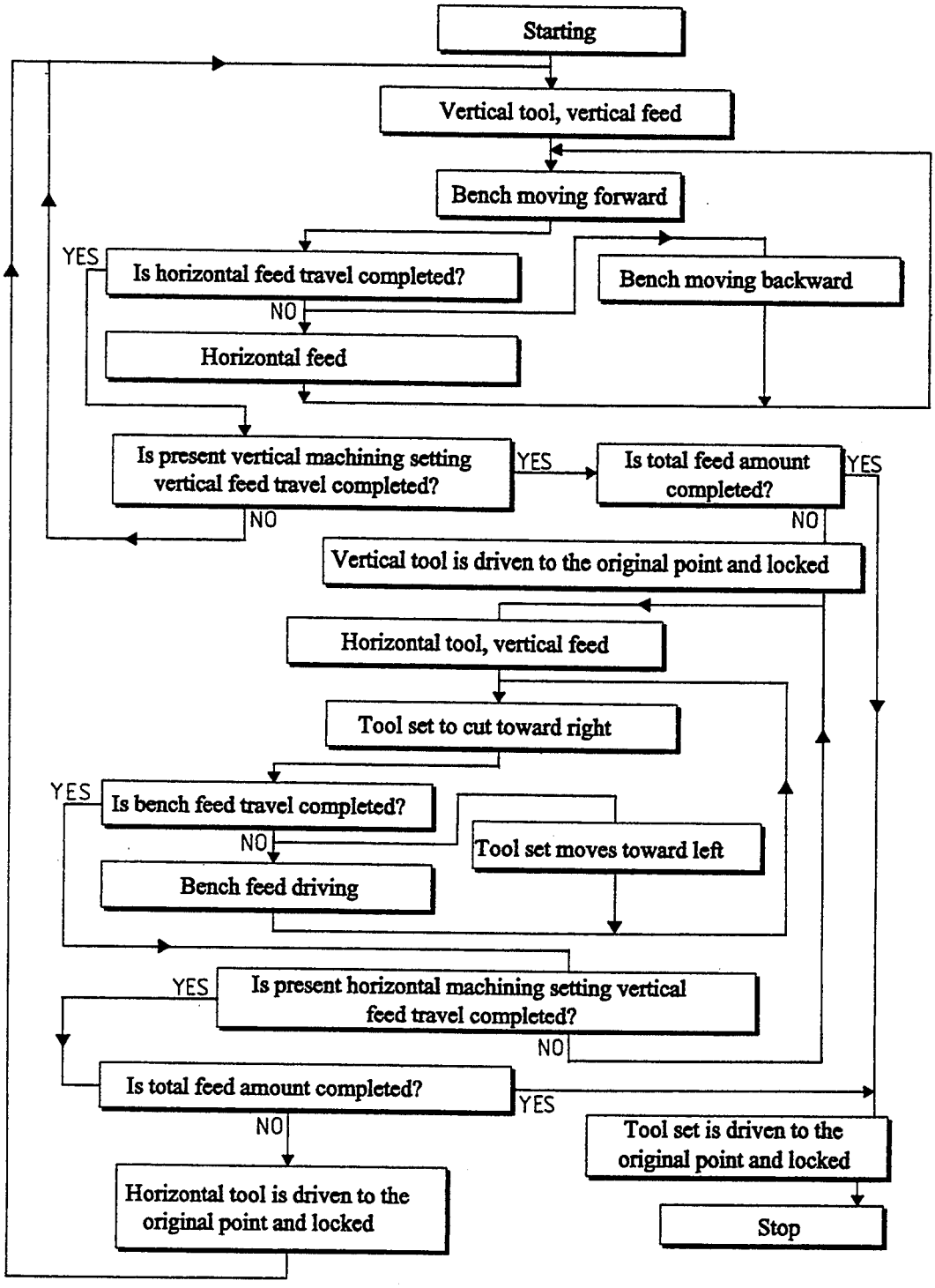
FIG. 14 is a diagram of a dual tool cross operation method.
Figure 15:
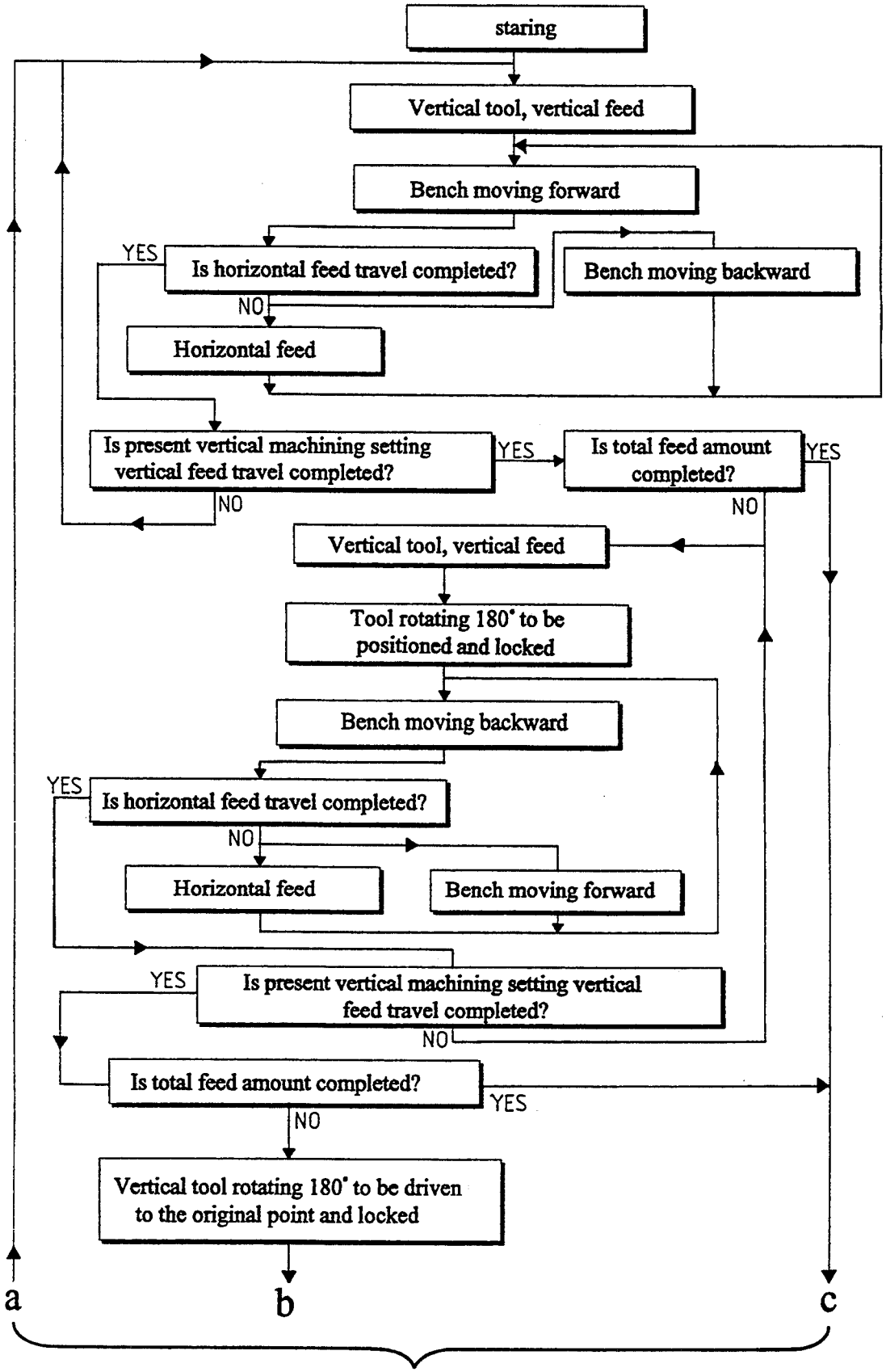
FIG. 15 is a partial diagram of a method of dual tool operation initially forward and backward and then towards the left and the right.
Figure 16:
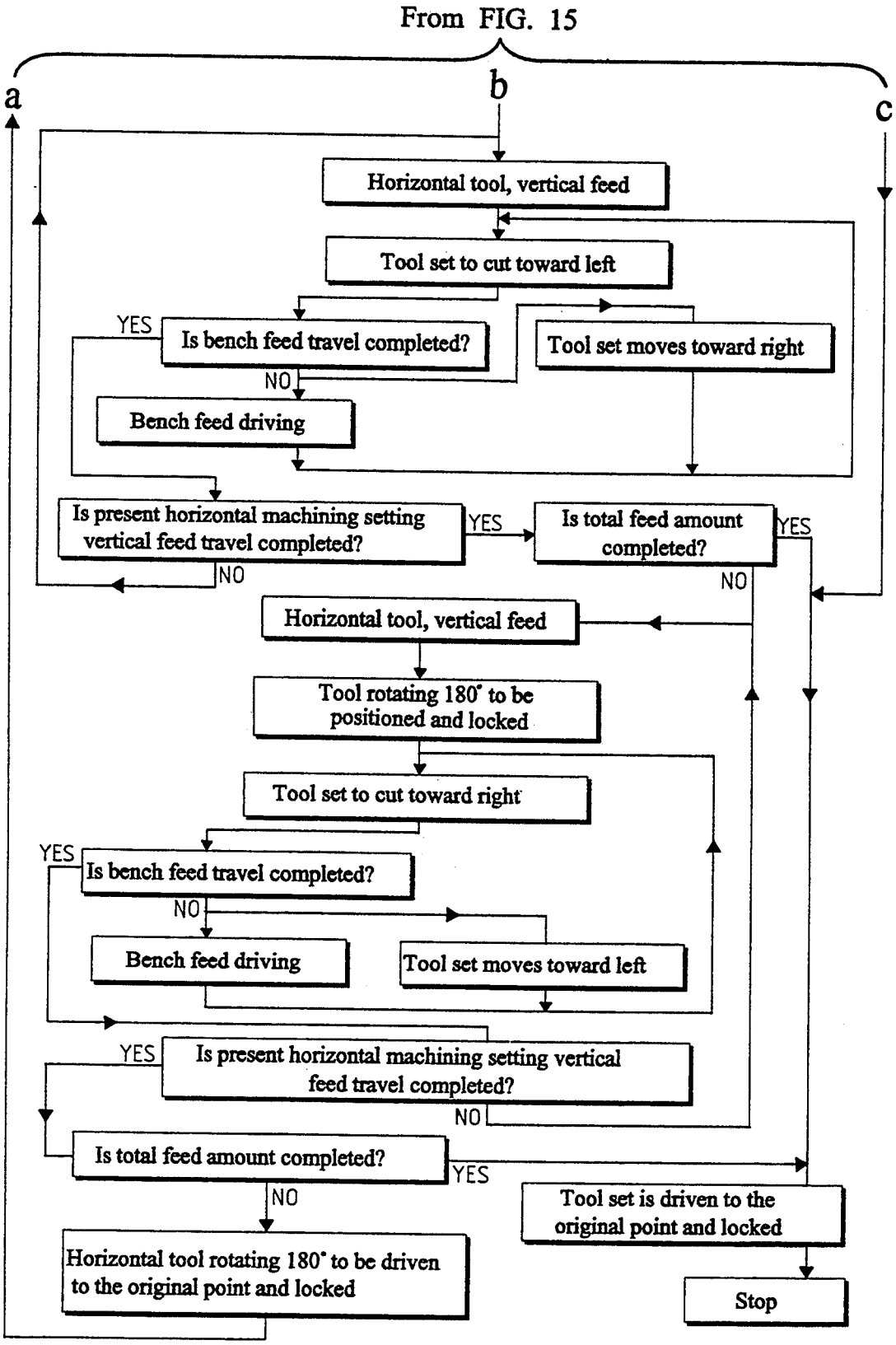
FIG. 16 is a continuation of the diagram of FIG. 15.

Detailed diagrams of the method of the present invention are provided in FIGS. 9–11.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for performing working operations on a workpiece, comprised of:

a frame, including a support portion for supporting a workpiece thereon;

a first working tool supported by the frame, the first working tool being disposed for movement along a first axis in a first plane, whereby work is performed on the workpiece along the first axis;

a second working tool supported by the frame, the second working tool being disposed for movement along a second axis in a second plane, whereby work is performed on the workpiece along the second axis; and the first axis and the second axis being substantially perpendicular to one another, such that a substantially 90° angle is defined therebetween;

wherein the first and the second working tools may be moved at right angles to one another, the working tools performing work on the workpiece sequentially such that only one of the working tools is in contact with the workpiece at a given time, to prevent the incurrence of interference whereby any residual stresses in the workpiece generated by either one of the working tools will be cancelled out by the other one of the working tools, so that internal stresses in the workpiece are relieved for preventing any flow or deformation of the material in the workpiece during operations thereon, and a rotatable carrousel supported by the frame, on an axis substantially perpendicular to the workpiece, the first working tool and the second working tool being mounted on the carrousel wherein the selected working tool may be sequentially directed to the workpiece.

2. An apparatus for performing working operations on a workpiece comprised of:

a frame including a guide and a support portion for supporting the workpiece thereon, means for moving the workpiece linearly with respect to the frame, a first working tool including a first working tool carriage carried by the guide on the frame, the first working tool disposed for movement along a first axis in a first plane for contacting the workpiece along the first axis;

a second working tool including a second working tool carriage carried by the guide on the frame, the second working tool disposed for movement along a second axis in a second plane for contacting the workpiece along the second axis;

the first working tool carriage and the second working tool carriage being movable with respect to one another along the guide on the frame, the working tools being in contact with the workpiece sequentially such that only one of the working tools is in contact with the workpiece at a given time to prevent the incurrence of interference whereby any residual stresses in the workpiece generated by either one of the working tools will be cancelled out by the other one of the working tools, so that internal stresses in the workpiece are relieved for preventing any flow or deformation of the material in the workpiece during operations thereon.

* * * * *